US007899307B1

(12) United States Patent
Hughes

(10) Patent No.: US 7,899,307 B1
(45) Date of Patent: Mar. 1, 2011

(54) SYSTEM, METHOD AND COMPUTER PROGRAM PRODUCT FOR MEASURING BASKETBALL PLAYER PERFORMANCE CHARACTERISTICS DURING INSTANT REPLAY OF VIDEO AND LIVE SPORTS GAMES

(76) Inventor: Walter Hughes, Fontana, CA (US)

( * ) Notice: Subject to any disclaimer, the term of this patent is extended or adjusted under 35 U.S.C. 154(b) by 692 days.

(21) Appl. No.: 12/006,713

(22) Filed: Jan. 4, 2008

Related U.S. Application Data

(60) Provisional application No. 60/878,445, filed on Jan. 4, 2007.

(51) Int. Cl.
*H04N 5/783* (2006.01)

(52) U.S. Cl. ..... 386/343; 386/344

(58) Field of Classification Search ..... 386/343, 386/344, 350, 353, 200, 264
See application file for complete search history.

(56) References Cited

U.S. PATENT DOCUMENTS 5,333,061 A * 7/1994 Nakashima et al. ..... 386/264
5,363,297 A * 11/1994 Larson et al. ..... 700/91
2008/0015061 A1* 1/2008 Klein ..... 473/447

* cited by examiner

*Primary Examiner*—Robert Chevalier

(57) ABSTRACT

An instant replay system for determining player performance characteristics during a televised basketball game includes a user interface, a viewing device for receiving a broadcast signal from a television station, a signal interface electrically coupled directly to the viewing device for segmenting the broadcast signal into a plurality of first signals, a processor electrically coupled directly to the signal interface and the user interface respectively, and a graphical user interface electrically coupled directly to the processor. The system further includes a display screen, a memory, and a database.

20 Claims, 7 Drawing Sheets

SYSTEM, METHOD AND COMPUTER PROGRAM PRODUCT FOR MEASURING BASKETBALL PLAYER PERFORMANCE CHARACTERISTICS DURING INSTANT REPLAY OF VIDEO AND LIVE SPORTS GAMES

CROSS REFERENCE TO RELATED APPLICATIONS

This application claims the benefit of U.S. Provisional Application No. 60/878,445, filed Jan. 4, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to training systems and, more particularly, to an instant replay training system designed to capture basketball players maneuvers and performance characteristics in real-time.

2. Prior Art

Athletes are always striving to reach their highest level of performance possible in order to be effective competitors. This usually includes a strict training, exercise and diet regiment that is adjusted to each athlete's specific goals and needs. For example, a long distance runner will focus more on building cardiovascular endurance and consume foods rich in carbohydrates for energy, whereas a football player will most likely focus more on strength training and consuming proteins to meet the intense physical demands of their sport. Another aspect of athletic training is learning new motor and fine-motor skills that allow an athlete to outperform their competitors.

Unfortunately, in most sports, like soccer and basketball, the players move so fast, especially at professional levels, that it is virtually impossible for a coach or third party representative to analyze and instruct the player or players on how to improve their performance. As such, an athlete may learn new skills, but might be performing them in an inefficient manner. Once this behavior is ingrained, it might be hard for a player to unlearn, so to speak, these bad playing habits, which can detrimental to their overall performance in the long run.

U.S. Pat. No. 4,183,056 to Evans discloses the operation of a television system or photographic camera in concert with line or boundary indicators or monitors at a sporting contest. When the indicator detects an event of interest during the contest being monitored, such as an intrusion or the presence of an object along a line or boundary, a signal is sent to a video replay recorder, also known as an instant replay system, to continue recording for a predetermined interval and thereafter cease. An indicator or mark is also transmitted into the recording system on occurrence of the event of interest and is recorded along with the continuing event until recording ceases. After recording ceases, operators of the television system may then play back the recorded event into the television system. During the play back, the recorded indicator is also transmitted into the television system to appear on television screens and indicate the time of occurrence of the event of interest. A photographic camera may also be caused to photograph the event in response to the indicator in conjunction with the replay recorder, or separate therefrom.

Unfortunately, this prior art example is not designed to assist a basketball player to improve their scoring technique.

U.S. Pat. No. 4,413,277 to Murray discloses a real time, instant replay time-motion analysis system of work measurement that utilizes computer assisted video techniques to simultaneously record and display an operator at work and the elapsed time for the performance of each elemental step in his work task. An observer provides an input signal each time a step is completed and a subsequent step initiated, thereby causing the display of elapsed time relating to the first step to freeze and a display indicating running time for the second step to be generated. Input relating to interruptions occurring during the work process are manually and audibly provided to the system by the observer. The time related data generated during the study is calculated in a microprocessor, and presented as graphical illustrations on the video monitor during replay of the recorded information. Unfortunately, this prior art example is not designed for assessing the quality of particular basketball techniques.

Accordingly, the present invention is disclosed in order to overcome the above noted shortcomings. The present invention is convenient and easy to use, lightweight yet durable in design, and designed for determining player performance characteristics during a televised basketball game. The instant replay system is simple to use, inexpensive, and designed for many years of repeated use.

BRIEF SUMMARY OF THE INVENTION

The present invention meets the above-mentioned needs by providing a system, method, and computer program product for providing an instant replay system that includes a graphical user interface. The system also includes software code logic for accessing, in response to receiving a request from the user via the graphical user interface, the public and private databases, and software code logic for processing accessed information located in the databases in order to display a contact pathway.

An instant replay system for determining player performance characteristics during a televised basketball game effectively includes a user interface, a viewing device for receiving a broadcast signal from a television station, a signal interface electrically coupled directly to the viewing device for segmenting the broadcast signal into a plurality of first signals, a processor electrically coupled directly to the signal interface and the user interface respectively, and a graphical user interface electrically coupled directly to the processor.

The system further includes a display screen electrically coupled to the graphical user interface for displaying the player performance characteristics in a categorized format according to player data. Such a display screen includes a plurality of implanted electronic sensors which identify a point of contact and impact velocities of a player and a basketball associated therewith. Each of such sensors is conveniently associated with a plurality of target regions and further transmits output signals corresponding to impact forces during an event at the target regions.

The display screen further includes a plurality of transducers and a plurality of LED arrays disposed adjacent to the sensors respectively. Such LED arrays are advantageously illuminated when a basketball strikes within a certain distance of the sensors, and each of the transducers picks up wave patterns created by the basketball when striking the basketball rim or the basketball playing surface. The transducers generate and transmit corresponding ones of the second signals to the processor for detecting a time and a magnitude of the wave patterns such that each one of the transducers picks up and compares times between different ones of the transducers to determine an originating point of impact of the basketball on the basketball rim or the basketball playing surface.

The system further includes a memory electrically coupled directly to the processor. Such a memory effectively includes software instructions that cause the instant replay system to calculate: a quantity of force exerted on a basketball rim when a player slam dunks a basketball, a quantity of hang time a player achieves while jumping in air and shooting the basketball, a quantity and efficiency of passes made between two or more players on the basketball playing surface, an amount of arc a player puts on the basketball during shooting and passing procedures, and a player's leaping ability that is measured by a distance between a ground surface and a highest point of reference.

Such software instructions determine the player performance characteristics by conveniently executing a control logic algorithm including the steps of: receiving the first signals conveying data representative of the player performance characteristics; deciphering the first signals; displaying the resulting deciphered first signals on the display screen that is viewed by a user of the present invention; identifying a number of the player performance characteristics displayed in the first signals as events to be evaluated; receiving a plurality of second signals categorizing for each player desired ones of the player performance characteristics is currently shown; deciphering the plurality of second signals; and permitting visualization of the desired ones of the player performance characteristics according to the player performance characteristics selected from a number of players to be reviewed and a content of the deciphered second signals respectively.

The system further includes a database connected to the processor for storing and advantageously categorizing the player performance characteristics in a variety of formats to be reviewed and queried at a later time by alternate users of the instant replay system. The system also includes an analog to digital converter directly and electrically coupled to the display screen, and a parallel to serial converter electrically coupled directly to the analog to digital converter. Such an analog to digital converter receives and converts the second signals to a digital format and thereafter transmits the digital second signals to the parallel to serial converter which transmits the second signals to the processor.

A method for determining player performance characteristics during a televised basketball game includes the steps of: providing a user interface; providing a viewing device; the viewing device receiving a broadcast signal from a television station; providing a signal interface electrically coupled directly to the viewing device; the signal interface segmenting the broadcast signal into a plurality of first signals; providing a processor electrically coupled directly to the signal interface and the user interface respectively; providing a graphical user interface electrically coupled directly to the processor; providing a display screen electrically coupled to the graphical user interface; the display screen displaying the player performance characteristics in a categorized format according to player data; and providing a memory electrically coupled directly to the processor.

The memory includes software instructions that causes the instant replay system to calculate: a quantity of force exerted on a basketball rim when a player slam dunks a basketball, a quantity of hang time a player achieves while jumping in air and shooting the basketball, a quantity and efficiency of passes made between two or more players on the basketball playing surface, an amount of arc a player puts on the basketball during shooting and passing procedures, and a player's leaping ability that is measured by a distance between a ground surface and a highest point of reference.

The software instructions determine the player performance characteristics by executing a control logic algorithm including the steps of: receiving the first signals conveying data representative of the player performance characteristics; deciphering the first signals; displaying the resulting deciphered first signals on the display screen that is viewed by a user of the present invention; identifying a number of the player performance characteristics displayed in the first signals as events to be evaluated; receiving a plurality of second signals categorizing for each player desired ones of the player performance characteristics is currently shown; deciphering the plurality of second signals; and permitting visualization of the desired ones of the player performance characteristics according to the player performance characteristics selected from a number of players to be reviewed and a content of the deciphered second signals respectively.

The method further includes the steps of: providing a plurality of implanted electronic sensors; the sensors identifying a point of contact and impact velocities of a player and a basketball associated therewith; associating each of the sensors with a plurality of target regions; and transmitting output signals corresponding to impact forces during an event at the target regions.

The method further includes the steps of: providing a plurality of transducers and a plurality of LED arrays disposed adjacent to the sensors respectively; illuminating each of the LED arrays when a basketball strikes within a certain distance of the sensors; each of the transducers picking up wave patterns created by the basketball when striking the basketball rim or the basketball playing surface; each of the transducers generating and transmitting corresponding ones of the second signals to the processor for detecting a time and a magnitude of the wave patterns; each of the transducers picking up and comparing times between different ones of the transducers and determining an originating point of impact of the basketball on the basketball rim or the basketball playing surface.

Finally, the method includes the steps of: providing a database connected to the processor; and the database storing and categorizing the player performance characteristics in a variety of formats to be reviewed and queried at a later time by alternate users of the instant replay system.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
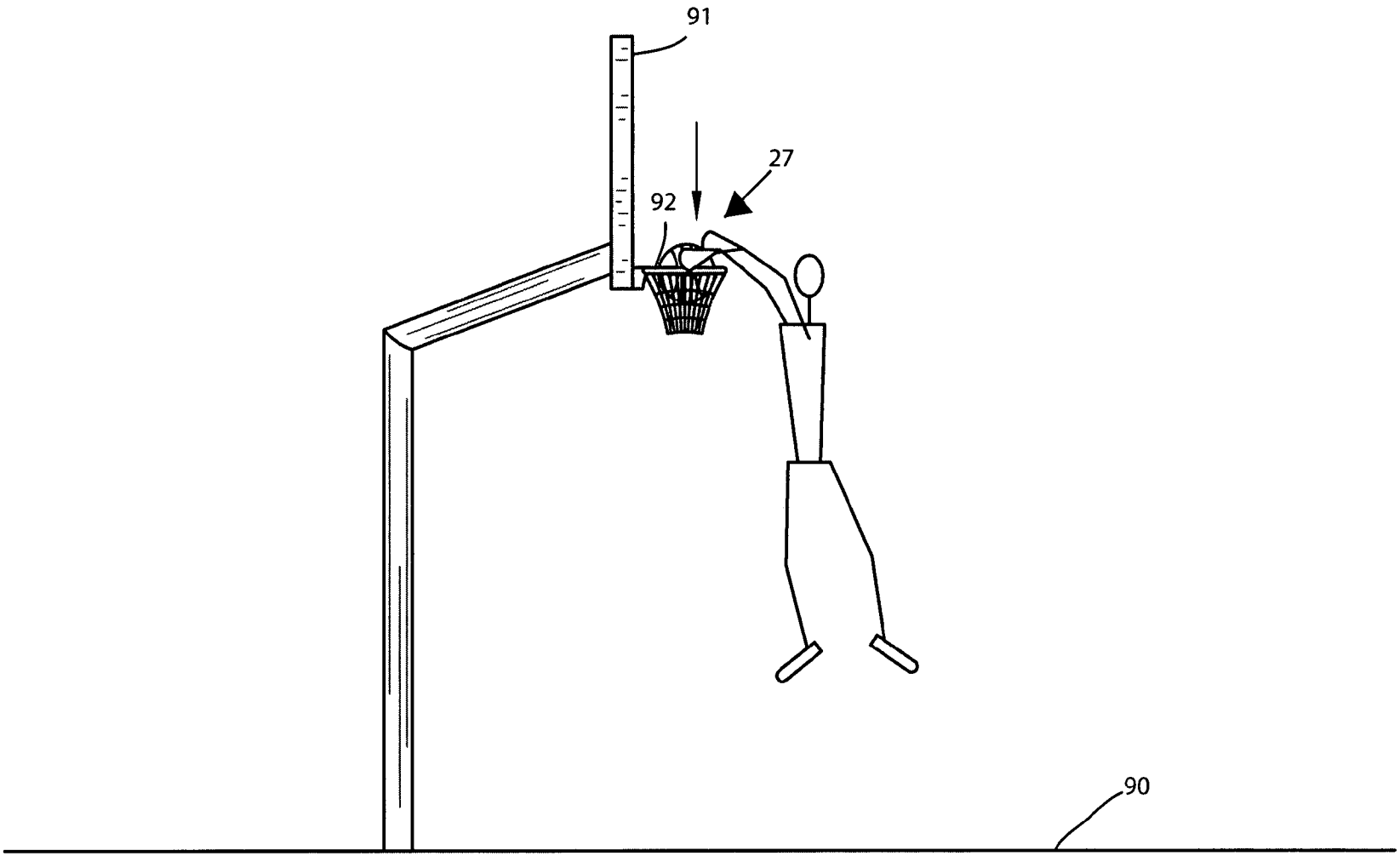
FIG. 1 is a side elevational view of a basketball player making a basket, as may be shown on the display screen of the system, in accordance with the present invention.
Figure 2:
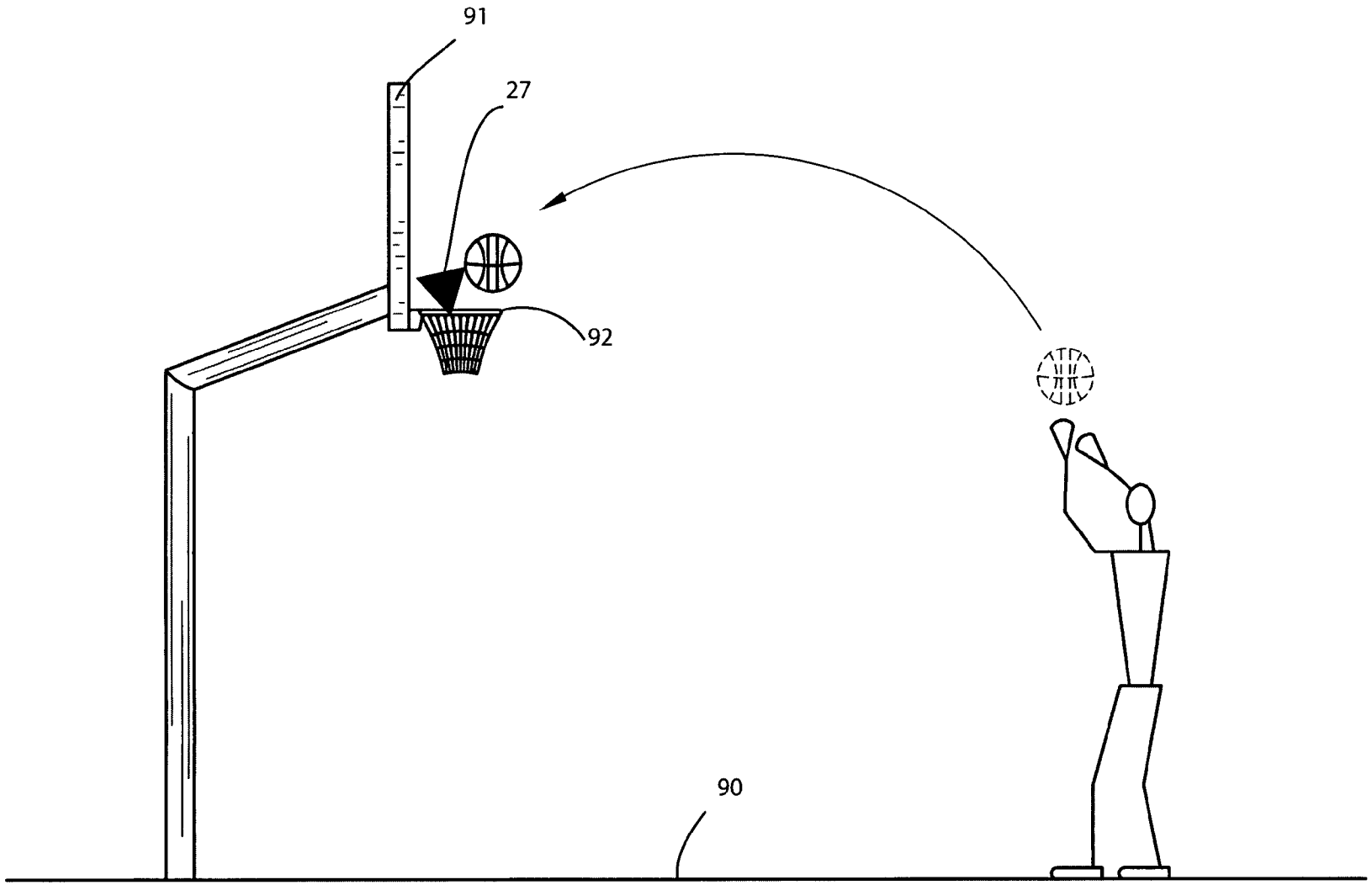
FIG. 2 is a side elevational view of a basketball player throwing a basketball, as may be shown on the display screen of the system, in accordance with the present invention.
Figure 3:
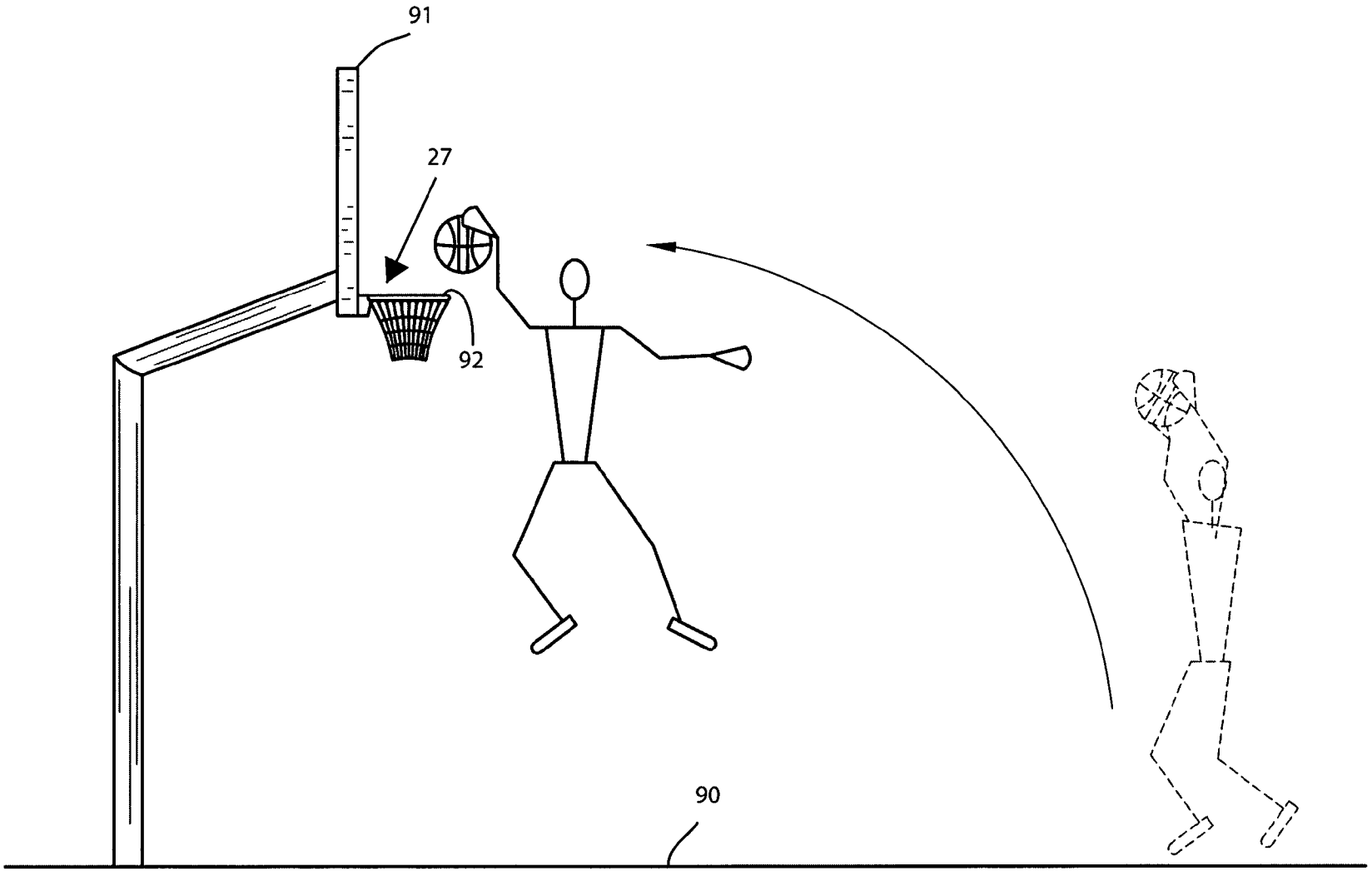
FIG. 3 is a side elevational view of a basketball player jumping to make a shot, as may be shown on the display screen of the system, in accordance with the present invention.
Figure 4:
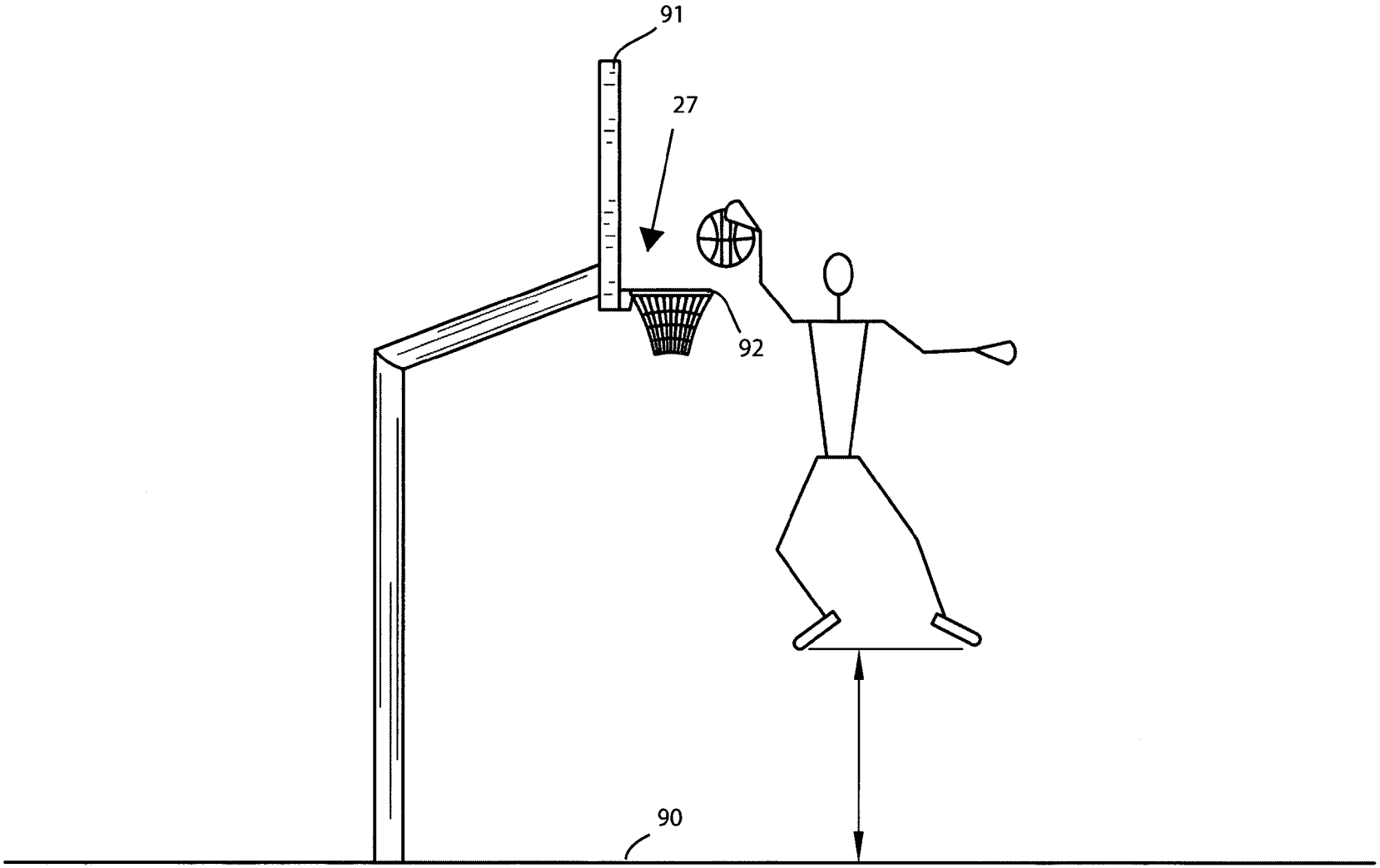
FIG. 4 is a side elevational view of a player jumping to make another shot, as may be shown on the display screen of the system, in accordance with the present invention.
Figure 5:
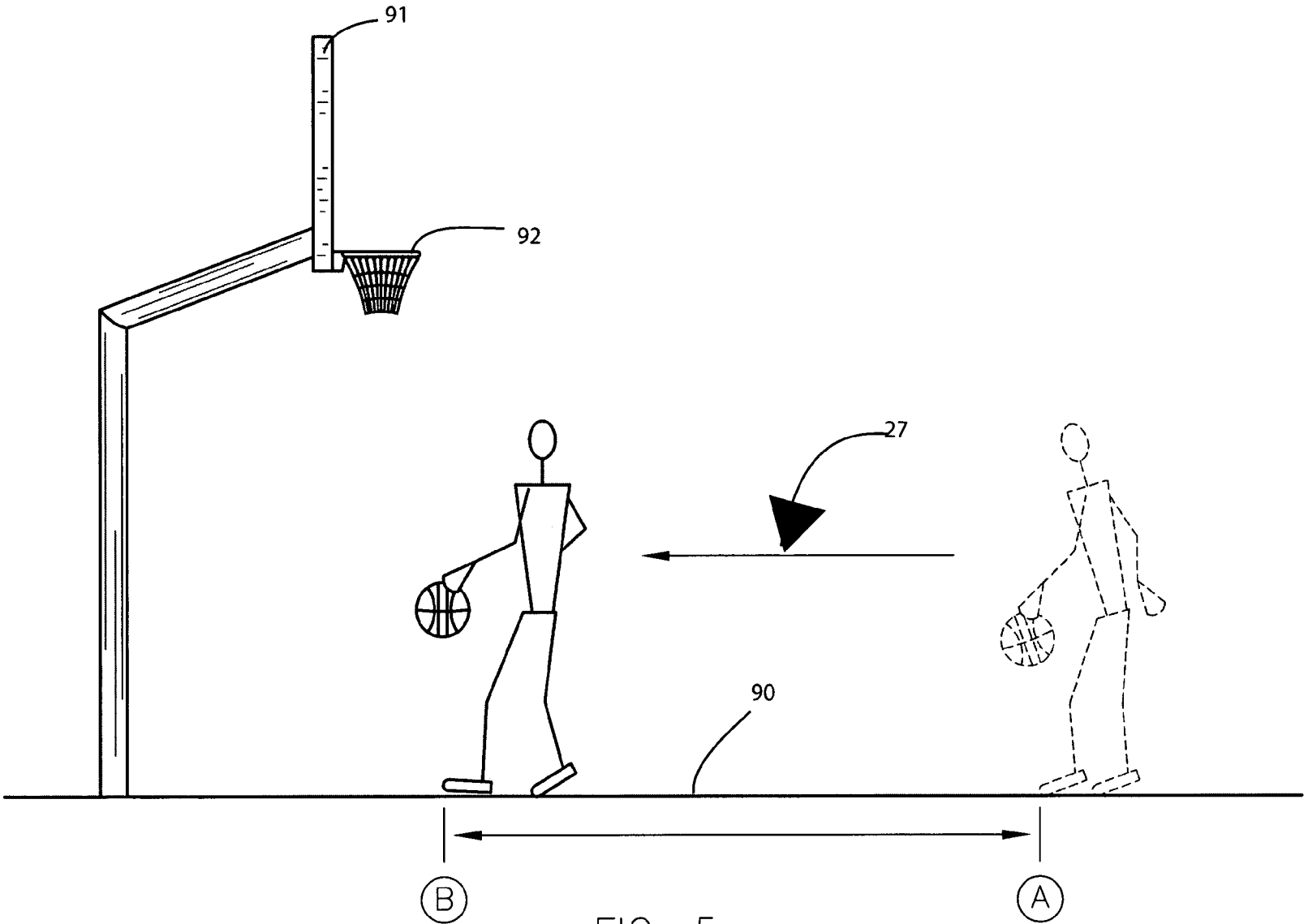
FIG. 5 is a side elevational view showing the forward movement of a basketball player, as may be shown on the display screen of the system, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The present invention is referred to generally in FIGS. 1-7 by the reference numeral 10 and is intended to provide a system, method and computer program product for measuring player performance characteristics during video and live sports games. It should be understood that the system, method and computer program product 10 may be used to measure player performance characteristics of various basketball sporting events such as collegiate and professional leagues, for example.

Figure 7:
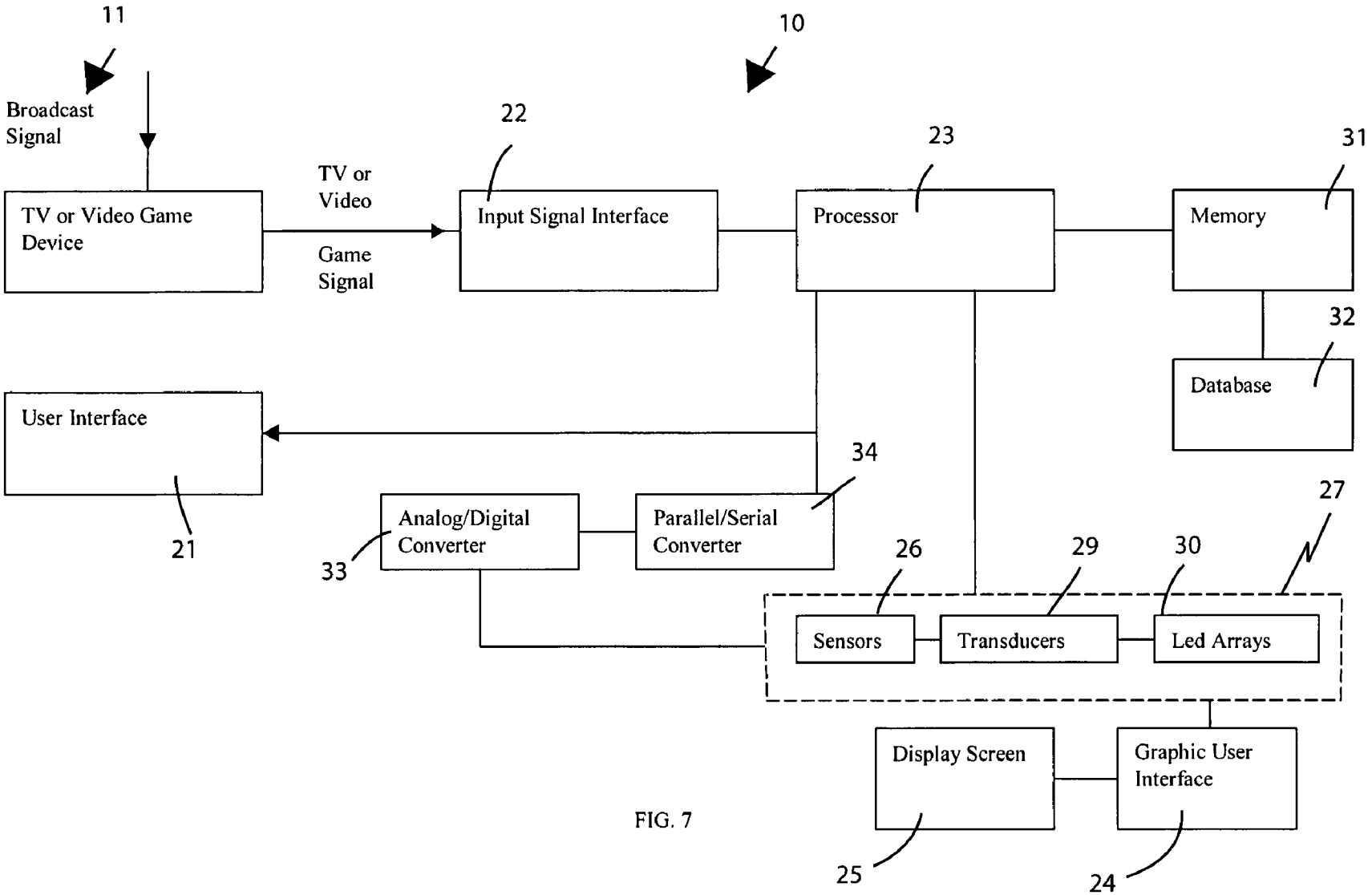
FIG. 7 is a schematic block diagram of an instant replay system, in accordance with the present invention.

Referring initially to FIG. 7, an instant replay system 10 for determining player performance characteristics during a televised basketball game includes a user interface 20, a viewing device 21 for receiving a broadcast signal 11 from a television station 12, a signal interface 22 electrically coupled directly, without the use of intervening elements, to the viewing device 21 for segmenting the broadcast signal 11 into a plurality of first signals, a processor 23 electrically coupled directly, without the use of intervening elements, to the signal interface 22 and the user interface 20 respectively, and a graphical user interface 24 electrically coupled directly, without the use of intervening elements, to the processor 23.

Figure 6:
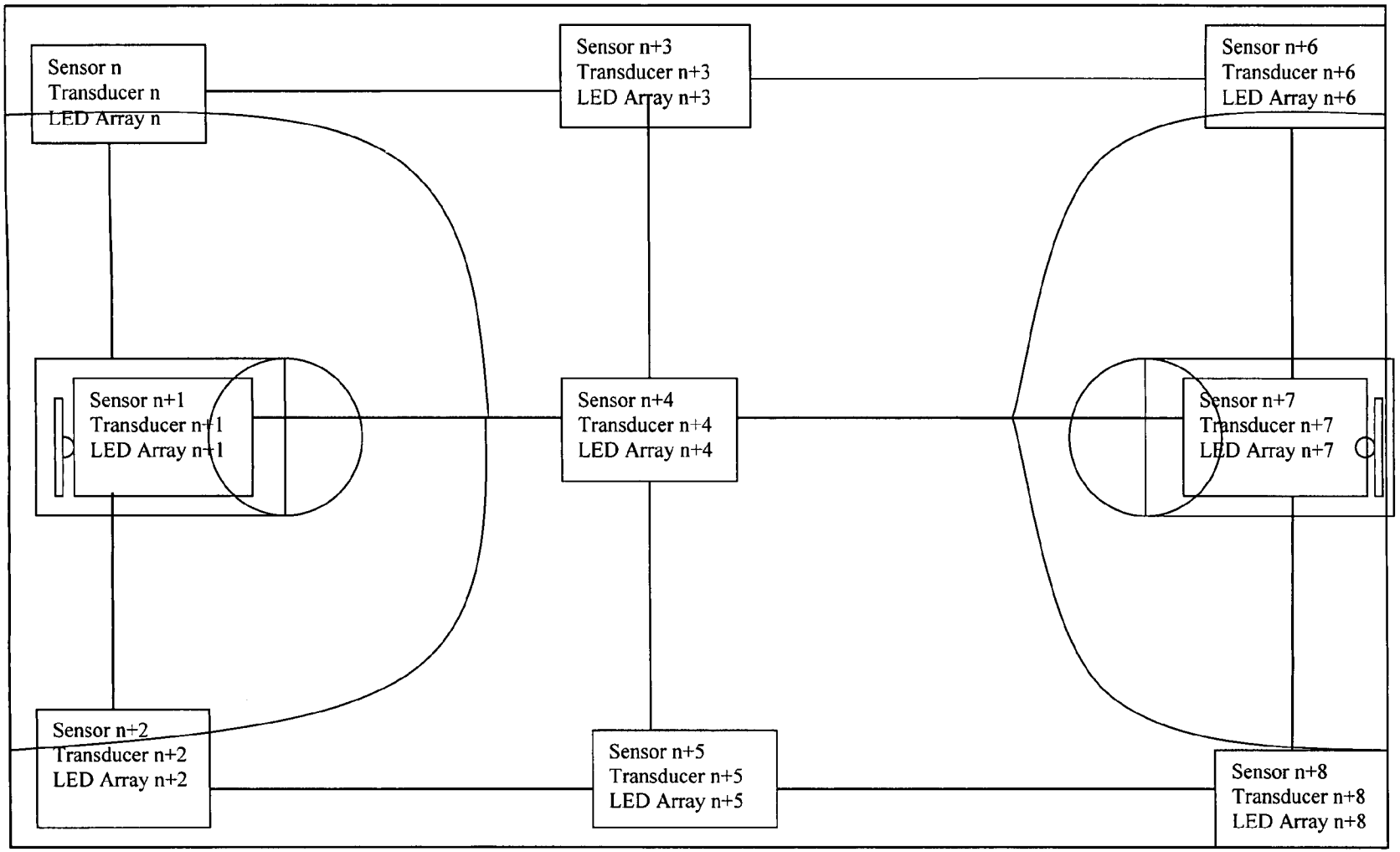
FIG. 6 is a schematic block diagram of an instant replay system as configured on a basketball court, in accordance with the present system.

Referring to FIGS. 6 and 7, the system 10 further includes a display screen 25 electrically coupled to the graphical user interface 24 for displaying the player performance characteristics in a categorized format according to player data. Such a display screen 25 includes a plurality of implanted electronic sensors 26 which identify a point of contact and impact velocities of a player and a basketball associated therewith. Each of such sensors 26 is associated with a plurality of target regions 27 and further transmits output signals 28 corresponding to impact forces during an event at the target regions.

The display screen 25 further includes a plurality of transducers 29 and a plurality of LED arrays 30 disposed adjacent to the sensors 26 respectively. Such LED arrays 30 are illuminated when a basketball strikes within a certain distance of the sensors 26, and each of the transducers 29 picks up wave patterns created by the basketball when striking the basketball rim or the basketball playing surface. The transducers 29 generate and transmit corresponding ones of the second signals to the processor 23 for detecting a time and a magnitude of the wave patterns which is essential such that each one of the transducers 29 picks up and compares times between different ones of the transducers 29 to determine an originating point of impact of the basketball on the basketball rim or the basketball playing surface.

Referring to FIG. 7, the system 10 further includes a memory 31 electrically coupled directly, without the use of intervening elements, to the processor 23. Such a memory 31 includes software instructions that cause the instant replay system 10 to calculate: a quantity of force exerted on a basketball rim when a player slam dunks a basketball, a quantity of hang time a player achieves while jumping in air and shooting the basketball, a quantity and efficiency of passes made between two or more players on the basketball playing surface, an amount of arc a player puts on the basketball during shooting and passing procedures, and a player's leaping ability that is measured by a distance between a ground surface and a highest point of reference.

Such software instructions determine the player performance characteristics by executing a control logic algorithm including the steps of: receiving the first signals conveying data representative of the player performance characteristics; deciphering the first signals; displaying the resulting deciphered first signals on the display screen 25 that is viewed by a user of the present invention; identifying a number of the player performance characteristics displayed in the first signals as events to be evaluated; receiving a plurality of second signals categorizing for each player desired ones of the player performance characteristics is currently shown; deciphering the plurality of second signals; and permitting visualization of the desired ones of the player performance characteristics according to the player performance characteristics selected from a number of players to be reviewed and a content of the deciphered second signals respectively.

Referring to FIG. 7, the system 10 further includes a database 32 connected to the processor 23 for storing and categorizing the player performance characteristics in a variety of formats to be reviewed and queried at a later time by alternate users of the instant replay system 10. The system 10 also includes an analog to digital converter 33 directly and electrically coupled, without the use of intervening elements, to the display screen 25, and a parallel to serial converter 34 electrically coupled directly, without the use of intervening elements, to the analog to digital converter 33. Such an analog to digital converter 33 receives and converts the second signals to a digital format and thereafter transmits the digital second signals to the parallel to serial converter 34 which transmits the second signals to the processor 23. Some examples of the images, as may be shown on the display screen, are seen in FIGS. 1, 2, 3, 4 and 5.

In a preferred embodiment, the system includes an adaptable drive that is electrically coupled to a TV or video console. The system has instant replay capabilities allowing an athlete to view their movements in real time as they occur on the television set, and at the same time, display calculations and measurements in force distance and the like. The system includes a program that can calculate the force and pressure of various actions performed by an athlete, like a slam dunk or striking a ball with one's foot. The system also includes a trajectory measuring mechanism that can determine the time, path and arc of sports equipment or a person moving through the air, like tracking a basketball passing through the air or an athlete jumping off of the ground during the shot. Such a trajectory measuring mechanism effectively charts the highest point of the player's vertical jump, measured from his hand or head to the floor. A highest vertical measurement is charted from the bottom of the player's feet to the floor surface. The system also includes a mechanism for measuring time and speed of actions like dribbling, or charting an athlete's travel with a ball from point A to point B. Of course, the abilities of the system may be applied a variety of different sports, as is obvious to a person of ordinary skill in the art.

The present invention provides athletes with a simple yet effective training tool that helps to hone their skills. As a specially designed, electronic simulator that allows users to replay a series of moves, while also displaying measurements and calculations, the present invention offers a highly visible and easily understood program to help beginners and novices alike fully comprehend the machinations of their sport. In this manner, sports enthusiasts do not need other players when desiring to improve their game, as the system facilitates practice any time one desires. With its universal vision, the system proves ideal for any athlete regardless of age level, whether a five year old playing on his first Little League team or a novice adult who wishes to join a community team. The system is advantageously able to measure a variety of parameters that can give a training athlete a better indication of where adjustments and alterations in their regiment are needed.

In use, a method for determining player performance characteristics during a televised basketball game includes the steps of: providing a user interface 20; providing a viewing device 21; the viewing device 21 receiving a broadcast signal 11 from a television station 12; providing a signal interface 22 electrically coupled directly, without the use of intervening elements, to the viewing device 21; the signal interface 22 segmenting the broadcast signal 11 into a plurality of first signals; providing a processor 23 electrically coupled directly, without the use of intervening elements, to the signal interface 22 and the user interface 21 respectively; providing a graphical user interface 24 electrically coupled directly, without the use of intervening elements, to the processor 23; providing a display screen 25 electrically coupled to the graphical user interface 24; the display screen 25 displaying the player performance characteristics in a categorized format according to player data; and providing a memory 31 electrically coupled directly, without the use of intervening elements, to the processor 23.

In use, the memory 31 includes software instructions that causes the instant replay system to calculate: a quantity of force exerted on a basketball rim when a player slam dunks a basketball, a quantity of hang time a player achieves while jumping in air and shooting the basketball, a quantity and efficiency of passes made between two or more players on the basketball playing surface, an amount of arc a player puts on the basketball during shooting and passing procedures, and a player's leaping ability that is measured by a distance between a ground surface and a highest point of reference.

The software instructions determine the player performance characteristics by executing a control logic algorithm including the steps of: receiving the first signals conveying data representative of the player performance characteristics; deciphering the first signals; displaying the resulting deciphered first signals on the display screen that is viewed by a user of the present invention; identifying a number of the player performance characteristics displayed in the first signals as events to be evaluated; receiving a plurality of second signals categorizing for each player desired ones of the player performance characteristics is currently shown; deciphering the plurality of second signals; and permitting visualization of the desired ones of the player performance characteristics according to the player performance characteristics selected from a number of players to be reviewed and a content of the deciphered second signals respectively.

In use, the method further includes the steps of: providing a plurality of implanted electronic sensors 26; the sensors 26 identifying a point of contact and impact velocities of a player and a basketball associated therewith; associating each of the sensors 26 with a plurality of target regions 27; and transmitting output signals 28 corresponding to impact forces during an event at the target regions.

In use, the method further includes the steps of: providing a plurality of transducers 29 and a plurality of LED arrays 30 disposed adjacent to the sensors 29 respectively; illuminating each of the LED arrays 30 when a basketball strikes within a certain distance of the sensors 26; each of the transducers 29 picking up wave patterns created by the basketball when striking the basketball rim or the basketball playing surface; each of the transducers 29 generating and transmitting corresponding ones of the second signals to the processor 23 for detecting a time and a magnitude of the wave patterns; each of the transducers 29 picking up and comparing times between different ones of the transducers 29 and determining an originating point of impact of the basketball on the basketball rim or the basketball playing surface.

The method includes the steps of: providing a database 32 connected to the processor 23; and the database 32 storing and categorizing the player performance characteristics in a variety of formats to be reviewed and queried at a later time by alternate users of the instant replay system.

According to one aspect of the present invention, there is provided a system method and computer program product for selecting player performance characteristics to be analyzed such as the following: the quantity of force (in lbs of pressure) exerted on a basketball rim when a player slam dunks a basketball; the quantity of hang time a player achieves while jumping in the air and shooting the basketball; the quantity and efficiency of passes made between two or more players on the basketball; the amount of arc a player puts on the basketball during shooting and passing procedures; and the distance between a ground surface and a highest point of a player's leaping ability that can be measured from the player's hand, head or foot down to the ground surface.

Such player performance characteristics are determined by executing a control logic algorithm including the steps of: receiving a plurality of first signals conveying data representative of a player performance characteristics; deciphering the first signals; displaying the resulting deciphered first signals on a display screen that is being viewed by a user of the present invention; identifying a number of player performance characteristics displayed in the first signals as events to be evaluated; receiving a plurality of second signals categorizing for each player the desired player performance characteristic being currently shown; deciphering the plurality of second signals; and permitting visualization of the selected player performance characteristic according to the player performance characteristics selected from the number of players to be reviewed and a content of the deciphered second signals.

A principal feature of the present invention is that the basketball playing surface 90 that is being viewed on the display screen 25 includes implanted electronic sensors 26 which identify a point of contact and velocity of impact of a player and a basketball associated therewith. Implanted within and around a basketball backboard 91 and a basketball rim 92 are between 3 and 5 juxtaposed target regions 27. These target regions 27 can vary in location on the basketball backboard 91 and basketball rim 92. Each sensor 26 associated with each target region 27 is electrically connected to each other and transmits output signals 28 corresponding to impact forces during slam dunks, for example. The display screen 25 is designed to display desirable indicia such as time, score and/or player information. Player information would be, for example, if there were more than one player playing so you have player A and player B, and each player would have his or her own display screen 25. The display screen 25 includes appropriate visual display electronics that are connected to the processor 23.

Adjacent to each sensor is a piezoelectric transducer 29 and an LED array 30. Each LED array 30 is set to be illuminated when a basketball strikes within a certain distance of the sensor 26. For example, when the basketball bouncing on the basketball court where a sensor 26 is locate, the associated LED array 30 lights up and measures either a time interval between bounces and/or a force of impact from the basketball (around the rim for example).

For illustration purposes, the sensors 26 and transducers 29 are positioned along selected areas of the basketball court. However, one skilled in the art understands that such sensors 26 and transducers 29 may be disposed in a more densely populated pattern to detect as many player performance characteristics as desired.

The purpose of the piezoelectric transducers 29 is to pick up the auditory/pulsation wave which is created by the basketball when striking the basketball rim 92 and/or basketball playing surface 90. The processor 23 detects the time and magnitude of the auditory/pulsation waves that each transducer 29 picks up and compares the times between the different transducers 29 to determine the point of origin of impact of the basketball on the basketball rim 92 and/or playing surface 90. This information is then supplied to the display screen 25 with appropriate information then being displayed to the user to decipher respective player performance characteristics.

Additionally, a database 93 is connected to the processor 23 for storing and categorizing player performance characteristics in a variety of formats to be reviewed and queried at later times. The player performance characteristics could be queried every so often and transmitted to other user sites via the Internet or other network communications methods well known in the industry. The processor preferably includes a general purpose microcontroller well known in the industry. The functions of the processor are: (1) collect data from the transducers 29; and (2) exhibit player performance characteristics associated with each target region 27 and on the display screen 25.

The electrical signals from the sensors 26 are transmitted to an amplifier and filter (collectively part of the analog-to-digital converter). It is to be understood that each transducer 29 is independently connected to a corresponding amplifier and filter. The amplifiers and filters condition the signals to eliminate unnecessary data (noise). The signal is then transmitted to a rectifier (collectively part of the analog-to-digital converter) where it is converted into a direct current (DC) format and then transmitted to a comparator (collectively part of the analog-to-digital converter) whose function is to determine the signal threshold necessary for the processor 23 to determine the time and impact of the basketball on the basketball rim 92 and basketball court 90. Such a process essentially provides an analog to digital conversion (collectively the amplifier, filter, rectifier and comparator) of the DC formatted signals. This information is then transferred to the processor 23 to perform the above-referenced calculations. The processor 23 transmits the data that was received from each sensor 26 to the display screen 25. This information is received by a parallel-to-serial converter 95. The serial information, which represents the player performance characteristics, is also transmitted to the database 93 for data querying and manipulation.

The present invention relates to a system, method, and computer program product for providing a user the ability to decipher the quantity of force (in lbs of pressure) exerted on a basketball rim when a player slam dunks a basketball; the quantity of hang time a player achieves while jumping in the air and shooting the basketball; the quantity and efficiency of passes made between two or more players on the basketball; the amount of arc a player puts on the basketball during shooting and passing procedures; and the distance between a ground surface and a highest point of a player's leaping ability that can be measured from the player's hand, head or foot down to the ground surface.

In an embodiment of the present invention, a stand-alone application program is provided which serves as a computer program product that detects, categorizes and computes varies player performance characteristics associated with playing a game of basketball. The application program allows a user (e.g., coach or trainer) to quickly and effectively determine the quantity of force (in lbs of pressure) exerted on a basketball rim when a player slam dunks a basketball; the quantity of hang time a player achieves while jumping in the air and shooting the basketball; the quantity and efficiency of passes made between two or more players on the basketball; the amount of arc a player puts on the basketball during shooting and passing procedures; and the distance between a ground surface and a highest point of a player's leaping ability that can be measured from the player's hand, head or foot down to the ground surface.

The computer program product would allow the user to intelligently establish the player performance characteristics, via a graphical user interface (GUI), on a display screen for verification and viewing by other users, for example.

In an alternate embodiment of the present invention, the application program would be networked among the local or wide area network of an entity allowing multiple users to access and use the database of the present invention to share historical as well as real-time player performance characteristics for various basketball games. The enterprise embodiment would allow several sets video game users or live viewers of basketball games to interact and share player performance characteristics in real-time. Such a network version of the present invention would also include security measures to allow, for example, users to restrict access to sensitive or proprietary player performance characteristics while sharing publicly available information about the player performance characteristics.

In each of the two above-described alternate embodiments, the player performance characteristics may be run, instead of locally or on proprietary equipment, via the global Internet. In such an embodiment, a central monitoring website would allow access, on a subscriber per-use basis, to view and historical and real-time player performance characteristics via a World-Wide Web (WWW) site on the Internet. That is, either stand-alone users or enterprise users may subscribe to a WWW site and pay on a per-use basis.

Such a website stores the player performance characteristics on a secured database that would be consistently researched and periodically updated by the service provider. The updated public information database, in order to provide the desired reliability, may then be distributed to subscribers (i.e., users) via several different means (e.g., electronic media, via Internet or FTP download, or automatically upon Internet access).

In a stand alone architecture of the present invention, a personal computer (PC) 106 (e.g., an IBM or compatible PC workstation running the Microsoft Windows 95/98 or Windows NT operating system, Macintosh computer running the Mac OS operating system, or the like), is connected to the database that houses the player performance characteristics and would execute (i.e., "run") on the PC and during its operation provide users a graphical user interface (GUI) "front-end" screens. In general, PC may be any processing device including, but not limited to, a desktop computer, laptop, palmtop, workstation, set-top box, personal digital assistant (PDA), and the like.

In the enterprise, locally-run version of the present invention, a server regulates access to the database and computer program product of the present invention that determines the player performance characteristics, which serves as the "back-bone" of the present invention. The front-end of the system would be provided by a plurality of PCs. During operation of the enterprise embodiment, the PCs provide GUI "front-end" screens to the several users for sharing player performance characteristics on a universal platform shown on each display screen. As will be apparent to one skilled in the relevant art(s), the Internet subscriber will resemble the architecture of the system.

The present invention (system, process, computer program products or any part(s) thereof) may be implemented using hardware, software or a combination thereof and may be implemented in one or more computer systems or other processing systems. In fact, in one embodiment, the invention is directed toward one or more computer systems capable of carrying out the functionality described herein. An example of a computer system is shown in FIG. 7. The computer system includes one or more processors. The processor is connected to a communication infrastructure (e.g., a communications bus, cross-over bar, or network). Various software embodiments are described in terms of this exemplary computer system. After reading this description, it will become apparent to a person skilled in the relevant art(s) how to implement the invention using other computer systems and/or computer architectures.

The computer system can include a display interface that forwards graphics, text, and other data from the communication infrastructure (or from a frame buffer not shown) for display on the display unit.

The computer system also includes a main memory, preferably random access memory (RAM), and may also include a secondary memory. The secondary memory may include, for example a hard disk drive, an optical disk drive, etc. The removable storage drive reads from and/or writes to a removable storage unit in a well known manner. Removable storage unit, represents a floppy disk, magnetic tape, optical disk, etc. which is read by and written to by removable storage drive. As will be appreciated, the removable storage unit includes a computer usable storage medium having stored therein computer software and/or data.

In alternative embodiments, the secondary memory may include other similar means for allowing computer programs or other instructions to be loaded into the computer system. Such means may include, for example, a removable storage unit and an interface. Examples of such may include a program cartridge and cartridge interface (such as that found in video game devices), a removable memory chip (such as an EPROM, or PROM) and associated socket, and other removable storage units and interfaces which allow software and data to be transferred from the removable storage unit to the computer system.

The computer system may also include a communications interface. Communications interface allows software and data to be transferred between the computer system and external devices. Examples of communications interface may include a modem, a network interface, (such as an Ethernet card), a communications port, a PCMCIA slot and card, etc. Software and data transferred via the communications interface are in the form of signals which may be electronic, electromagnetic, optical or other signals capable of being received by communications interface. These signals are provided to the communications interface via a communications path (i.e., channel). This channel carries signals and may be implemented using wire or cable, fiber optics, a phone line, a cellular phone link, an RF link and other communications channels.

In this document, the terms "computer program medium" and "computer usable medium" are used to generally refer to media such as removable storage drive, a hard disk installed in hard disk drive, and the first and second pluralities of signals. These computer program products are means for providing software to the computer system. The invention is directed to such computer program products.

Computer programs (also called computer control logic) are stored in main memory and/or the secondary memory. Computer programs may also be received via communications interface. Such computer programs, when executed, enable the computer system to perform the features of the present invention as discussed herein. In particular, the computer programs, when executed, enable processor to perform the features of the present invention. Accordingly, such computer programs represent controllers of the computer system.

In an embodiment where the invention is implemented using software, the software may be stored in a computer program product and loaded into the computer system using the removable storage drive, hard drive or communications interface. The control logic (software), when executed by the processor, causes the processor to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An instant replay system for determining player performance characteristics during a televised basketball game, said instant replay system comprising:

a user interface;

a viewing device for receiving a broadcast signal from a television station;

a signal interface electrically coupled to said viewing device for segmenting said broadcast signal into a plurality of first signals;

a processor electrically coupled to said signal interface and said user interface respectively;

a graphical user interface electrically coupled to said processor;

a display screen electrically coupled to said graphical user interface for displaying said player performance characteristics in a categorized format according to player data; and a memory electrically coupled directly to said processor, said memory including software instructions that causes said instant replay system to calculate:

a quantity of force exerted on a basketball rim when a player slam dunks a basketball, a quantity of hang time a player achieves while jumping in air and shooting the basketball, a quantity and efficiency of passes made between two or more players on the basketball playing surface, an amount of arc a player puts on the basketball during shooting and passing procedures, and a player's leaping ability that is measured by a distance between a ground surface and a highest point of reference.

2. The instant replay system of claim 1, wherein said software instructions determine said player performance characteristics by executing a control logic algorithm including the steps of:

receiving said first signals conveying data representative of said player performance characteristics;

deciphering said first signals;

displaying said resulting deciphered first signals on said display screen that is being viewed by a user of the present invention;

identifying a number of said player performance characteristics displayed in said first signals as events to be evaluated;

receiving a plurality of second signals categorizing for each player desired ones of said player performance characteristics being currently shown;

deciphering said plurality of second signals; and permitting visualization of said desired ones of said player performance characteristics according to said player performance characteristics selected from a number of players to be reviewed and a content of said deciphered second signals respectively.

3. The instant replay system of claim 2, wherein said display screen comprises: a plurality of implanted electronic sensors which identify a point of contact and impact velocities of a player and a basketball associated therewith, each of said sensors being associated with a plurality of target regions and further transmitting output signals corresponding to impact forces during an event at said target regions.

4. The instant replay system of claim 1, wherein said display screen further comprises: a plurality of transducers and a plurality of LED arrays disposed adjacent to said sensors respectively, wherein each of said LED arrays being illuminated when a basketball strikes within a certain distance of said sensors.

5. The instant replay system of claim 4, wherein each of said transducers picks up wave patterns created by the basketball when striking the basketball rim or the basketball playing surface, said transducers generating and transmitting corresponding ones of said second signals to said processor for detecting a time and a magnitude of said wave patterns such that each one of said transducers picks up and compares times between different ones of said transducers to determine an originating point of impact of the basketball on the basketball rim or the basketball playing surface.

6. The instant replay system of claim 1, further comprising: a database connected to said processor for storing and categorizing said player performance characteristics in a variety of formats to be reviewed and queried at a later time by alternate users of said instant replay system.

7. The instant replay system of claim 2, further comprising:

an analog to digital converter directly and electrically coupled to said display screen; and a parallel to serial converter electrically coupled directly to said analog to digital converter;

wherein said analog to digital converter receives and converts said second signals to a digital format and thereafter transmits said digital second signals to said parallel to serial converter which transmits said second signals to said processor.

8. An instant replay system for determining player performance characteristics during a televised basketball game, said instant replay system comprising:

a user interface;

a viewing device for receiving a broadcast signal from a television station;

a signal interface electrically coupled directly to said viewing device for segmenting said broadcast signal into a plurality of first signals;

a processor electrically coupled directly to said signal interface and said user interface respectively;

a graphical user interface electrically coupled directly to said processor;

a display screen electrically coupled to said graphical user interface for displaying said player performance characteristics in a categorized format according to player data; and a memory electrically coupled directly to said processor, said memory including software instructions that causes said instant replay system to calculate:

a quantity of force exerted on a basketball rim when a player slam dunks a basketball, a quantity of hang time a player achieves while jumping in air and shooting the basketball, a quantity and efficiency of passes made between two or more players on the basketball playing surface, an amount of arc a player puts on the basketball during shooting and passing procedures, and a player's leaping ability that is measured by a distance between a ground surface and a highest point of reference.

9. The instant replay system of claim 8, wherein said software instructions determine said player performance characteristics by executing a control logic algorithm including the steps of:

receiving said first signals conveying data representative of said player performance characteristics;

deciphering said first signals;

displaying said resulting deciphered first signals on said display screen that is being viewed by a user of the present invention;

identifying a number of said player performance characteristics displayed in said first signals as events to be evaluated;

receiving a plurality of second signals categorizing for each player desired ones of said player performance characteristics being currently shown;

deciphering said plurality of second signals; and permitting visualization of said desired ones of said player performance characteristics according to said player performance characteristics selected from a number of players to be reviewed and a content of said deciphered second signals respectively.

10. The instant replay system of claim 9, wherein said display screen comprises: a plurality of implanted electronic sensors which identify a point of contact and impact velocities of a player and a basketball associated therewith, each of said sensors being associated with a plurality of target regions and further transmitting output signals corresponding to impact forces during an event at said target regions.

11. The instant replay system of claim 10, wherein said display screen further comprises: a plurality of transducers and a plurality of LED arrays disposed adjacent to said sensors respectively, wherein each of said LED arrays being illuminated when a basketball strikes within a certain distance of said sensors.

12. The instant replay system of claim 11, wherein each of said transducers picks up wave patterns created by the basketball when striking the basketball rim or the basketball playing surface, said transducers generating and transmitting corresponding ones of said second signals to said processor for detecting a time and a magnitude of said wave patterns such that each one of said transducers picks up and compares times between different ones of said transducers to determine an originating point of impact of the basketball on the basketball rim or the basketball playing surface.

13. The instant replay system of claim 12, further comprising: a database connected to said processor for storing and categorizing said player performance characteristics in a variety of formats to be reviewed and queried at a later time by alternate users of said instant replay system.

14. The instant replay system of claim 8, further comprising:

an analog to digital converter directly and electrically coupled to said display screen; and a parallel to serial converter electrically coupled directly to said analog to digital converter;

wherein said analog to digital converter receives and converts said second signals to a digital format and thereafter transmits said digital second signals to said parallel to serial converter which transmits said second signals to said processor.

15. A method for determining player performance characteristics during a televised basketball game, said method comprising the steps of:

a) providing a user interface;

b) providing a viewing device;

c) said viewing device receiving a broadcast signal from a television station;

d) providing a signal interface electrically coupled directly to said viewing device;

e) said signal interface segmenting said broadcast signal into a plurality of first signals;

f) providing a processor electrically coupled directly to said signal interface and said user interface respectively;

g) providing a graphical user interface electrically coupled directly to said processor;

h) providing a display screen electrically coupled to said graphical user interface;

i) said display screen displaying said player performance characteristics in a categorized format according to player data; and j) providing a memory electrically coupled directly to said processor, said memory including software instructions that causes said instant replay system to calculate:

i. a quantity of force exerted on a basketball rim when a player slam dunks a basketball, ii. a quantity of hang time a player achieves while jumping in air and shooting the basketball, iii. a quantity and efficiency of passes made between two or more players on the basketball playing surface, iv. an amount of arc a player puts on the basketball during shooting and passing procedures, and v. a player's leaping ability that is measured by a distance between a ground surface and a highest point of reference.

16. The method of claim 15, wherein said software instructions determine said player performance characteristics by executing a control logic algorithm including the steps of:

receiving said first signals conveying data representative of said player performance characteristics;

deciphering said first signals;

displaying said resulting deciphered first signals on said display screen that is being viewed by a user of the present invention;

identifying a number of said player performance characteristics displayed in said first signals as events to be evaluated;

receiving a plurality of second signals categorizing for each player desired ones of said player performance characteristics being currently shown;

deciphering said plurality of second signals; and permitting visualization of said desired ones of said player performance characteristics according to said player performance characteristics selected from a number of players to be reviewed and a content of said deciphered second signals respectively.

17. The method of claim 16, wherein step i. comprises the steps of:

providing a plurality of implanted electronic sensors;

said sensors identifying a point of contact and impact velocities of a player and a basketball associated therewith;

associating each of said sensors with a plurality of target regions; and transmitting output signals corresponding to impact forces during an event at said target regions.

18. The method of claim 17, wherein step i. further comprises the steps of:

providing a plurality of transducers and a plurality of LED arrays disposed adjacent to said sensors respectively; and illuminating each of said LED arrays when a basketball strikes within a certain distance of said sensors.

19. The method of claim 18, further comprising the steps of:

each of said transducers picking up wave patterns created by the basketball when striking the basketball rim or the basketball playing surface;

each of said transducers generating and transmitting corresponding ones of said second signals to said processor for detecting a time and a magnitude of said wave patterns; and each of said transducers picking up and comparing times between different ones of said transducers and determining an originating point of impact of the basketball on the basketball rim or the basketball playing surface.

20. The method of claim 16, further comprising the steps of:

providing a database connected to said processor; and said database storing and categorizing said player performance characteristics in a variety of formats to be reviewed and queried at a later time by alternate users of said instant replay system.

* * * * *